US009616548B1

(12) United States Patent
Liaw

(10) Patent No.: US 9,616,548 B1
(45) Date of Patent: Apr. 11, 2017

(54) POSITIONING STRUCTURE FOR CUTTING MACHINES OR GRINDER MACHINES

(71) Applicant: Jian-Shiou Liaw, Taichung (TW)

(72) Inventor: Jian-Shiou Liaw, Taichung (TW)

( * ) Notice: Subject to any disclaimer, the term of this patent is extended or adjusted under 35 U.S.C. 154(b) by 39 days.

(21) Appl. No.: 14/936,453

(22) Filed: Nov. 9, 2015

(51) Int. Cl.

| | |
|---|---|
| ***B24B 55/05*** | (2006.01) |
| ***B24B 41/00*** | (2006.01) |
| ***B24B 23/02*** | (2006.01) |
| ***B24B 45/00*** | (2006.01) |

(52) U.S. Cl.
CPC ..... *B24B 55/052* (2013.01); *B24B 23/022* (2013.01); *B24B 41/002* (2013.01); *B24B 45/00* (2013.01)

(58) Field of Classification Search
CPC ..... B23Q 11/08; B24B 23/022; B24B 41/002; B24B 45/00; B24B 45/003; B24B 45/006; B24B 55/052
See application file for complete search history.

(56) References Cited

U.S. PATENT DOCUMENTS 4,558,539 A * 12/1985 Hansson ..... B24B 23/026 451/295
4,574,532 A * 3/1986 Haberle ..... B24B 55/052 144/251.2
5,718,621 A * 2/1998 Turley ..... B24B 23/022 451/342
6,093,090 A * 7/2000 Tosto ..... B24B 23/02 451/342
6,561,887 B2 * 5/2003 Lai ..... B24B 23/02 403/362
9,079,291 B2 * 7/2015 Ikuta ..... B24B 23/028
2009/0311953 A1 * 12/2009 Maute ..... B23Q 11/06 451/359

* cited by examiner

*Primary Examiner* — Timothy V Eley
(74) *Attorney, Agent, or Firm* — Ming Chow; Sinorica, LLC

(57) ABSTRACT

A positioning structure for cutting machines or grinder machines has a rotating shaft and a positioning assembly. The rotating shaft has an abutting face, a fixing portion, at least one mounting protrusion, and a fastening hole. The at least one mounting protrusion axially protrudes from the abutting face, and the fixing portion axially protrudes from the at least one mounting protrusion. The fastening hole is axially formed in the at least one mounting protrusion. The positioning assembly is screwed with the rotating shaft and has a positioning element and a fastening element. The positioning element has an abutting portion and a through hole. The fastening element is mounted through the through hole and the fastening hole. Therefore, when a size of an assembling hole of a cutting disk or a grinder disk changes, the rotating shaft does not need to be changed and reinstalled.

4 Claims, 5 Drawing Sheets

POSITIONING STRUCTURE FOR CUTTING MACHINES OR GRINDER MACHINES

BACKGROUND OF THE INVENTION

1. Field of the Invention

The present invention relates to a positioning structure, and more particularly to a positioning structure for cutting machines or grinder machines.

2. Description of Related Art

With reference to FIG. 5, a conventional positioning structure 70 is mounted on a head 80 of a cutting machine or a grinder machine. The head 80 of the cutting machine or grinder machine is a cylinder and has a rear face, a driving apparatus, and a mounting hole 81. The driving apparatus is mounted in the head 80. The mounting hole 80 is formed in the rear face of the head 80. The conventional positioning structure 70 is connected to the head 80 and has a rotating shaft 71 and a positioning ring 72. The rotating shaft 71 is mounted in the mounting hole 81 of the head 80 and is connected to the driving apparatus, so the rotating shaft 71 may rotate relative to the head 80. The rotating shaft 71 has a distal end and a fixing portion 711, and the distal end of the rotating shaft 71 is distal from the mounting hole 81. The fixing portion 711 is formed on and protrudes axially from the distal end of the rotating shaft 71. A diameter of the fixing portion 711 is smaller than a diameter of the rotating shaft 71, thus forming a connecting portion formed on a rear face of the rotating shaft 71. The connecting portion of the rotating shaft 71 is a stepped face. An outer surface of the fixing portion 711 is a threaded face, and an inner surface of the positioning ring 72 is a threaded face. The threaded face of positioning ring 72 is screwed with the threaded face of the fixing portion 711 of the rotating shaft 71.

When the cutting machine or the grinder machine is operated, a user may loosen the positioning ring 72 from the fixing portion 711 first, and then mount a cutting disk 90 or a grinder disk around the fixing portion 711 of the rotating shaft 71. The cutting disk 90 or the grinder disk is circular and has a center and an assembling hole 91, and the assembling hole 91 is formed through the center of the cutting disk 90 or the grinder disk. The assembling hole 91 of the cutting disk 90 or the grinder disk is disposed around the fixing portion 711 of the rotating shaft 71, and the cutting disk 90 or the grinder disk abuts the stepped face between the rotating shaft 71 and the fixing portion 711. The positioning ring 72 is screwed with the fixing portion 711 of the rotating shaft 71 and is pressed against the cutting disk 90 or the grinder disk. The positioning ring 72 is screwed with the fixing portion 711 of the rotating shaft 71, the cutting disk 90 or the grinder disk abuts the stepped face between the fixing portion 711, and the rotating shaft 71, and the positioning ring 72 is pressed against the cutting disk 90 or the grinder disk. Therefore, the cutting disk 90 or the grinder disk rotates with the rotating shaft 71 synchronously. The cutting machine can cut things by the cutting disk 90, and the grinder machine can grind things by the grinder disk.

However, the fixing portion 711 of the rotating shaft 71 of the conventional positioning structure 70 corresponds in size to the assembling hole 91 of the cutting disk 90 or the grinder disk. When a size of the assembling hole 91 of the cutting disk 90 or the grinder disk changes, the rotating shaft 71 of the positioning structure 70 needs to be changed to a new size corresponding to the size of the assembling hole 91 of the cutting disk 90 or the grinder disk, and this makes the conventional positioning structure 70 of the cutting machine or the grinder machine inconvenient in use. So the conventional positioning structure 70 of the cutting machine or the grinder machine should be improved.

To overcome the shortcomings of the conventional positioning structure for cutting machines or grinder machines, the present invention provides a positioning structure for cutting machines or grinder machines to mitigate or obviate the aforementioned problems.

SUMMARY OF THE INVENTION

The main objective of the present invention is to provide a positioning structure for cutting machines or grinder machines.

The positioning structure for cutting machines or grinder machines has a rotating shaft and a positioning assembly. The rotating shaft has an abutting face, a fixing portion, at least one mounting protrusion, and a fastening hole. The at least one mounting protrusion axially protrudes from the abutting face, and the fixing portion axially protrudes from the at least one mounting protrusion. The fastening hole is axially formed in the at least one mounting protrusion. The positioning assembly is screwed with the rotating shaft and has a positioning element and a fastening element. The positioning element has an abutting portion and a through hole. The fastening element is mounted through the through hole of the positioning element and the fastening hole of the rotating shaft. Therefore, when a specification of an assembling hole of a cutting disk or a grinder disk changes, the rotating shaft needs not be changed and reinstalled, and this can improve the convenience in use.

Other objects, advantages, and novel features of the invention will become more apparent from the following detailed description when taken in conjunction with the accompanying drawings.

DETAILED DESCRIPTION OF PREFERRED EMBODIMENT

Figure 1:
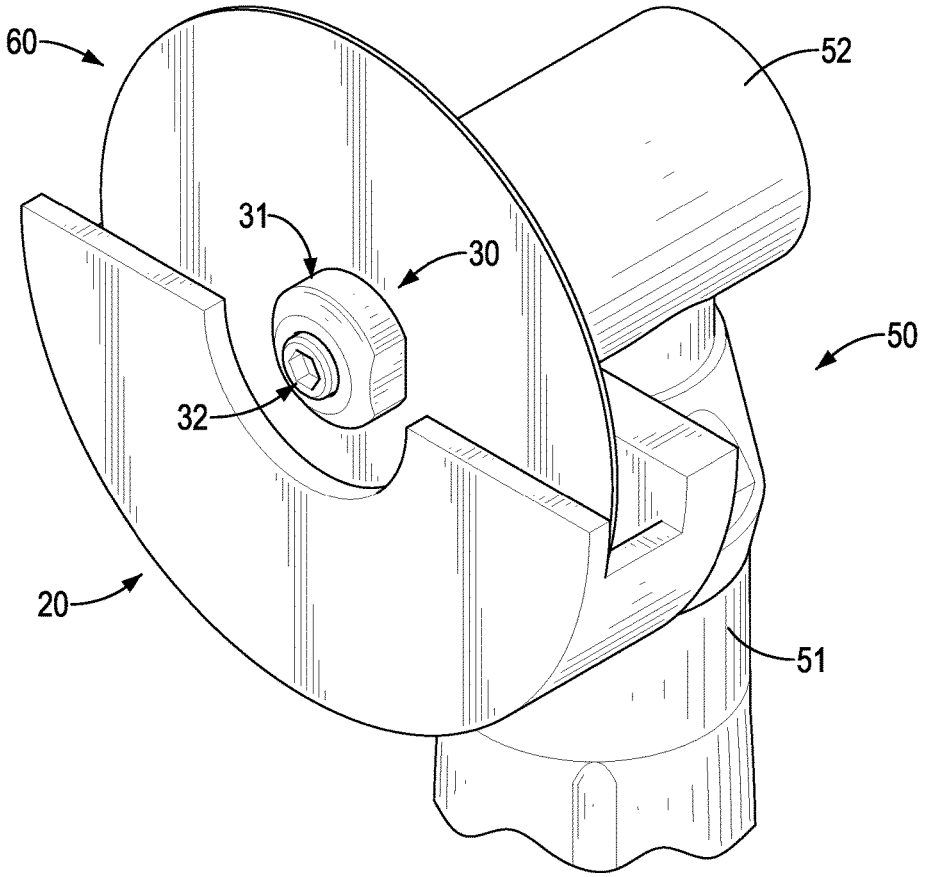
FIG. 1 is a perspective view of a positioning structure for cutting machines or grinder machines in accordance with the present invention.
Figure 2:
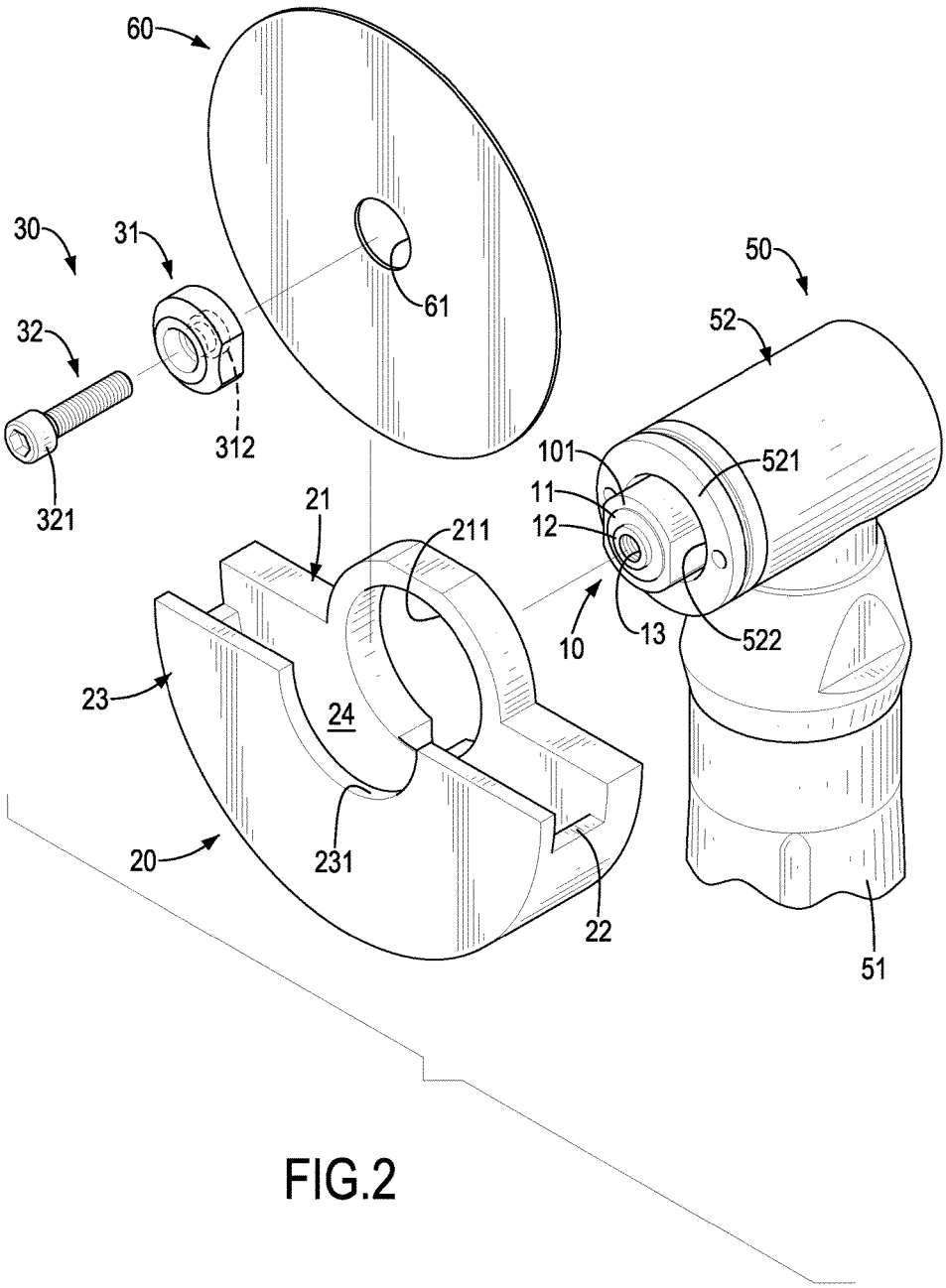
FIG. 2 is an exploded perspective view of the positioning structure in FIG. 1.
Figure 3:
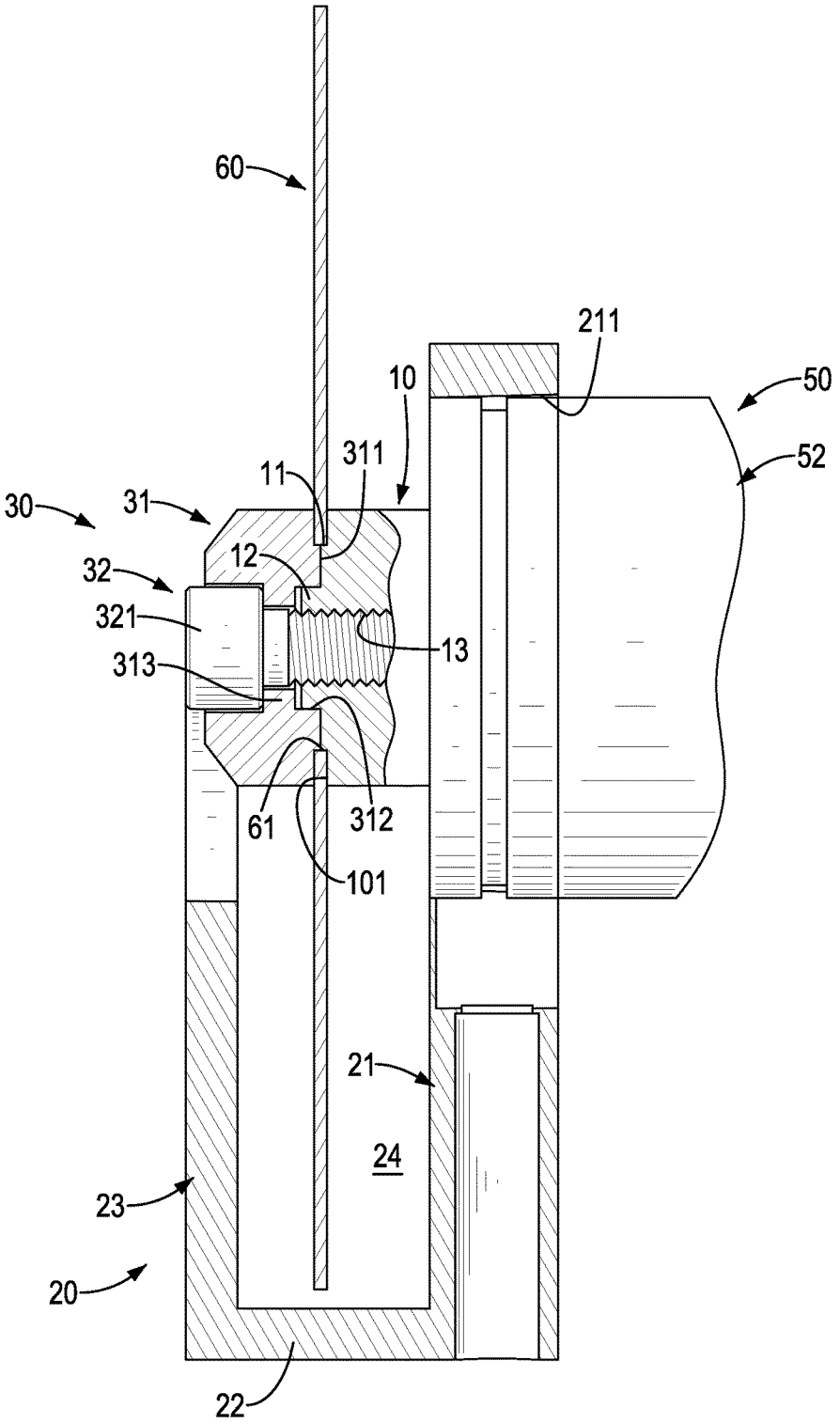
FIG. 3 is an operational enlarged side view in partial section of the positioning structure in FIG. 1.

With reference to FIGS. 1 to 3, a positioning structure for cutting machines or grinder machines in accordance with the present invention is mounted on a body 50 of a cutting machine or a grinder machine. The positioning structure has a rotating shaft 10, a protecting cover 20, and a positioning assembly 30. The body 50 of the cutting machine or the grinder machine has a rod 51 and a head 52. The rod 51 is erect and has a top portion. The head 52 is horizontally disposed and is connected to the top portion of the rod 51. The head 52 has a mounting face 521, a mounting hole 522, and a driving apparatus. The mounting face 521 is formed on a front face of the head 52. The mounting hole 522 is formed in the mounting face 521 of the head 52, and the driving apparatus is mounted in the head 52.

The rotating shaft 10 is mounted in the mounting hole 522 of the head 52, extends out of the mounting face 521 of the head 52, and is connected to the driving apparatus, so the rotating shaft 10 would be rotated relative to the head 52 by the driving apparatus. The rotating shaft 10 has a distal end, an abutting face 101, at least one mounting protrusion 11, a fixing portion 12, and a fastening hole 13. The distal end of the rotating shaft 10 is formed on the rotating shaft 10 distal from the mounting face 521 and extends out of the mounting hole 522. The abutting face 101 is formed on the distal end of the rotating shaft 10. The at least one mounting protrusion 11 is axially formed on and protrudes from the abutting face 101 and has a front side. The fixing portion 12 is axially formed on and protrudes from the front side of the at least one mounting protrusion 11. A diameter of the fixing portion 12 is smaller than a diameter of the at least one mounting protrusion 11. Then, a stepped face is formed between the at least one mounting protrusion 11 and the fixing portion 12. The fastening hole 13 is axially formed in the front side of the at least one mounting protrusion 11. Furthermore, the fastening hole 13 is a screw hole.

The protecting cover 20 is mounted around the head 52 of the body 50, and the rotating shaft 10 is located in the protecting cover 20. The protecting cover 20 is a semicircular shell and has a first protecting board 21, a connecting face 22, a second protecting board 23, and a protecting recess 24. The first protecting board 21 is an erect semicircular board, and has a rear side, an outer surface, and a positioning hole 211. The rear side of the first protecting board 21 faces the head 52 of the body 50. The positioning hole 211 is formed through the rear side of the first protecting board 21, is a tapered hole, and has two ends. The positioning hole 211 tapers from one of the two ends that is close to the head 52 to the other end that is away from the head 52, and this makes the positioning hole 211 disposed around and engage with the head 52 of the body 50. Then, the protecting cover 20 may be mounted on the head 52. The connecting face 22 is shaped as a semicircular arc, and is formed on and protrudes from the outer surface of the first protecting board 21.

The second protecting board 23 is formed with the connecting face 22 and has a top surface, an inner surface, and a positioning recess 231. The inner surface of the second protecting board 23 is formed with the connecting face 22 and faces the outer surface of the first protecting board 21. The positioning recess 231 is formed in the top surface of the second protecting board 23, and aligns with the positioning hole 211. The protecting recess 24 is formed between the first protecting board 21, the connecting face 22, and the second protecting board 23. The protecting recess 24 communicates with the positioning recess 231 and the positioning hole 211. The positioning hole 211 is disposed around the head 52. The protecting recess 24 is disposed below the rotating shaft 10.

The positioning assembly 30 is screwed with the rotating shaft 10 and has a positioning element 31 and a fastening element 32. The positioning element 31 is a ring and has a center, an inner surface, an abutting portion 311, a through hole 312, and an abutting flange 313. The inner surface of the positioning element 31 faces the at least one mounting protrusion 11. The abutting portion 311 is axially formed on and protrudes from the inner surface of the positioning element 31 and abuts the at least one mounting protrusion 11. The through hole 312 is formed through the center of the positioning element 31 and is formed through the abutting portion 311. A shape of the through hole 312 is corresponding to a shape of the fixing portion 12 of the rotating shaft 10. Thus, the through hole 312 is disposed around the fixing portion 12. The abutting flange 313 is formed radially on and protrudes inward from the through hole 312.

The fastening element 32 is mounted through the through hole 312 of the positioning element 31 and is securely connected to the fastening hole 13 of the rotating shaft 10. The fastening element 32 is a screw and has a screw head 321. The screw head 321 of the fastening element 32 abuts the abutting flange 313 of the positioning element 31 to push the positioning element 31 to press against the rotating shaft 10, and the positioning element 31 abuts the rotating shaft 10 tightly via the fastening element 32.

With reference to FIGS. 2 and 3, when the positioning structure is in use, a cutting disk 60 or a grinder disk is mounted between the at least one mounting protrusion 11 of the rotating shaft 10 and the abutting portion 311 of the positioning element 31. The cutting disk 60 has an assembling hole 61 and a bottom portion, and the assembling hole 61 is disposed between the at least one mounting protrusion 11 of the rotating shaft 10 and the abutting portion 311 of the positioning element 31. The bottom portion of the cutting disk 60 extends into the protecting recess 24 of the protecting cover 20. Because the fastening element 32 is mounted through the through hole 312 of the positioning element 31 and is connected to the fastening hole 13 of the rotating shaft 10, a fastening force is formed between the inner surface of the positioning element 31 and the abutting face 101 of the rotating shaft 10 to press against the cutting disk 60, so the cutting disk 60 rotates with the rotating shaft 10 synchronously.

Figure 4:
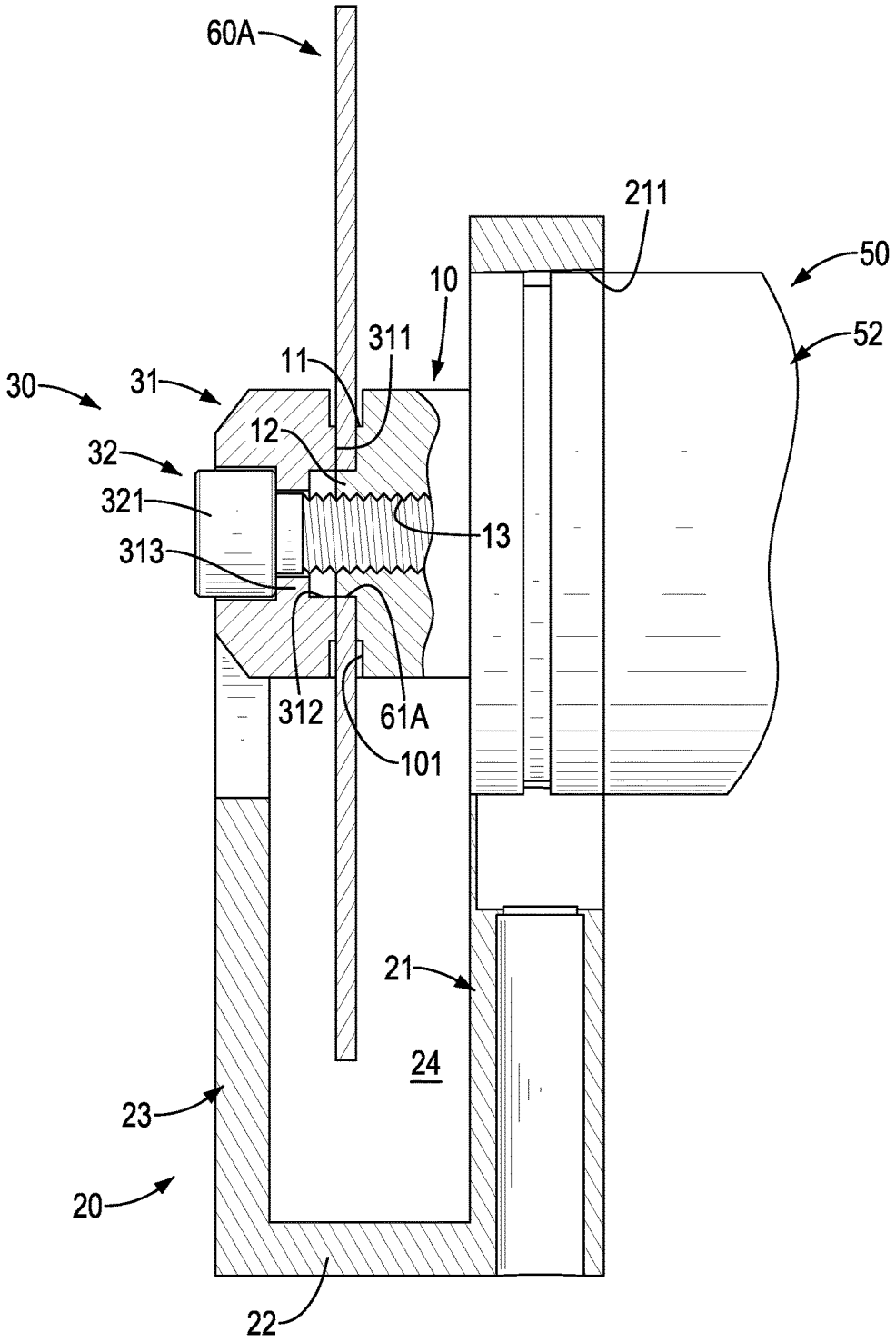
FIG. 4 is another operational enlarged side view in partial section of the positioning structure in FIG. 1.
Figure 5:
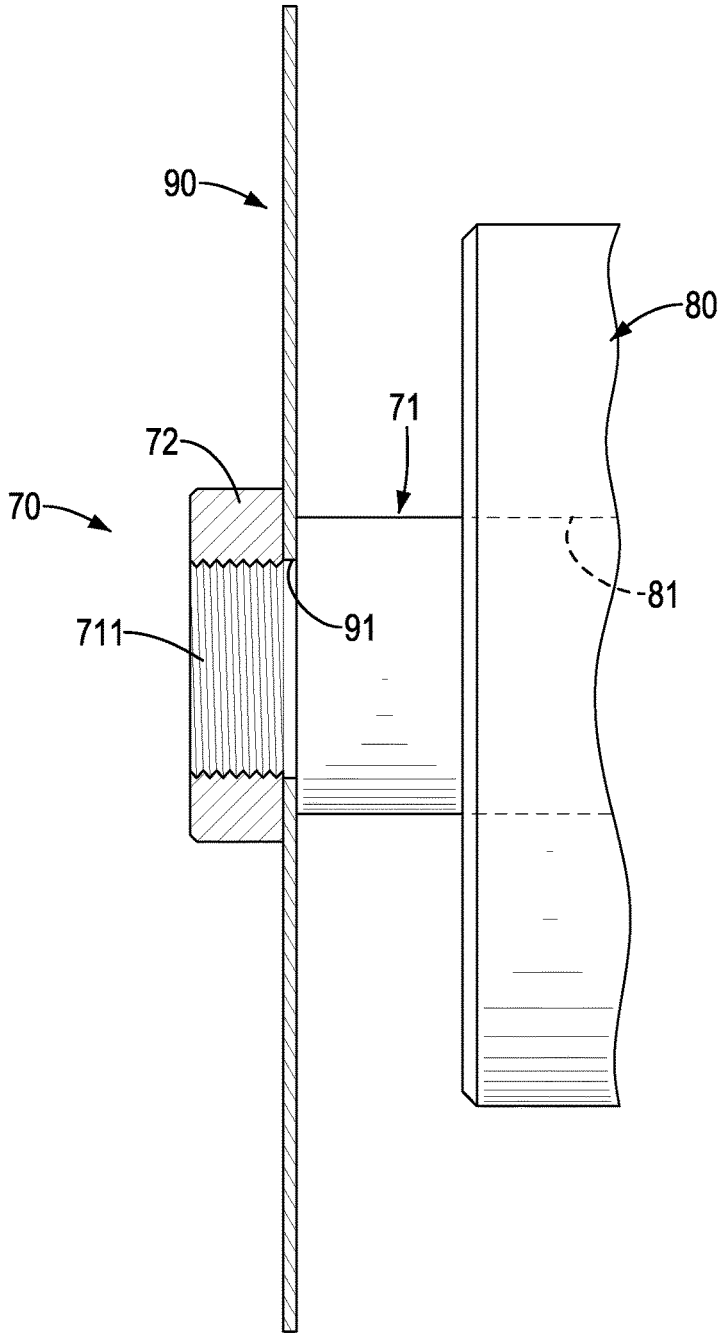
FIG.5 PRIOR ART
FIG. 5 is a side view in partial section of a positioning structure for cutting machines in accordance with the prior art.

FIG. 4 shows the cutting disk 60 is changed to another cutting disk 60A of a different size. A diameter of an assembling hole 61A of the cutting disk 60A is smaller than a diameter of the assembling hole 61 of the cutting disk 60. The assembling hole 61A of the cutting disk 60A cannot be disposed around the at least one mounting protrusion 11, and the assembling hole 61A is disposed around the fixing portion 12 of the rotating shaft 10. Then, the cutting disk 60A securely abuts the at least one mounting protrusion 11 of the rotating shaft 10 via the abutting force between the positioning element 31 and the cutting disk 60A and the fastening force of the fastening element 32. The cutting disk 60A is stably located between the positioning element 31 and the rotating shaft 10, so the cutting disk 60A also rotates with the rotating shaft 10 synchronously.

In the conventional positioning structure 70, the fixing portion 711 of the rotating shaft 71 corresponds in size to the assembling hole 91 of the cutting disk 90. So when the size of the assembling hole 91 of the cutting disk 90 or grinder disk changes, the rotating shaft 71 of the positioning structure 70 needs to be changed to a new size, causing inconvenience in use. The present invention has the designs of the at least one mounting protrusion 11 and the fixing portion 12, and the cutting disks 60, 60A with assembling holes 61, 61A of different sizes can be mounted around the at least one mounting protrusion 11 or the fixing portion 12 tightly. The rotating shaft 10 does not need to be changed, and this is convenient in use.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A positioning structure for cutting machines or grinder machines, mounted on a body of a cutting machine or a grinder machine, the body having a head, the head being a cylinder and having a mounting face and a mounting hole, the mounting hole formed in the mounting face of the head, and the positioning structure having a rotating shaft mounted in the mounting hole of the head having a distal end formed on the rotating shaft and being distal from the mounting face and extending out of the mounting hole;

an abutting face formed on the distal end of the rotating shaft;

at least one mounting protrusion axially formed on and protruding from the abutting face and having a front side;

a fixing portion axially formed on and protruding from the front side of the at least one mounting protrusion, a diameter of the fixing portion being smaller than a diameter of the at least one mounting protrusion, the at least one mounting protrusion and the fixing portion each formed in a stepped shape; and a fastening hole axially formed in the front side of the at least one mounting protrusion; and a positioning assembly screwed with the rotating shaft and having a positioning element being a ring and having a center;

an inner surface facing the at least one mounting protrusion;

an abutting portion axially formed on and protruding from the inner surface of the positioning element and abutting the at least one mounting protrusion;

a through hole formed through the center of the positioning element and formed through the abutting portion, a shape of the through hole corresponding to a shape of the fixing portion of the rotating shaft; and a fastening element mounted through the through hole of the positioning element and the fastening hole of the rotating shaft, and the positioning element abutting the rotating shaft tightly via the fastening element.

2. The positioning structure as claimed in claim 1, wherein the positioning structure has a protecting cover mounted around the head of the body, the rotating shaft located in the protecting cover, and the protecting cover having a first protecting board being an erect semi-circular board and having an outer surface;

a connecting face protruding from the outer surface of the first protecting board, the connecting face shaped as a semicircular arc; and a second protecting board formed with the connecting face.

3. The positioning structure as claimed in claim 2, wherein the first protecting board has a rear side facing the head of the body; and a positioning hole, the positioning hole formed through the rear side of the first protecting board and being a tapered hole and having two ends, the positioning hole tapering from one of the two ends that is close to the head to the other end that is away from the head, and the positioning hole disposed around and engaging the head of the body.

4. The positioning structure as claimed in claim 3, wherein the second protecting board has a top surface;

an inner surface; and a positioning recess formed in the top surface of the second protecting board and aligned with the positioning hole; and a protecting recess formed between the first protecting board, the connecting face, and the second protecting board, and the protecting recess communicating with the positioning recess and the positioning hole.

* * * * *